United States Patent [19]

Slomianny

[11] Patent Number: 4,576,111

[45] Date of Patent: Mar. 18, 1986

[54] MARKING JET DISCHARGING HEAD

[75] Inventor: Jan Slomianny, Cologne, Fed. Rep. of Germany

[73] Assignee: Domino Printing Sciences Plc, England

[21] Appl. No.: 573,303

[22] Filed: Jan. 23, 1984

[30] Foreign Application Priority Data

Jan. 27, 1983 [DE] Fed. Rep. of Germany ..... 3302617

[51] Int. Cl.[4] ..... B05C 5/02; B05B 1/02

[52] U.S. Cl. ..... 118/313; 346/140 R

[58] Field of Search ..... 118/315, 25, 313; 346/140 R; 400/126

[56] References Cited

U.S. PATENT DOCUMENTS 3,192,052 .6/1965 Cunning et al. ..... 118/25 X 3,279,422 10/1966 Landers ..... 118/25 X 4,072,959 2/1978 Elmqvist ..... 346/140 PD 4,215,350 7/1980 Mielke et al. ..... 346/75

FOREIGN PATENT DOCUMENTS 52-6418 1/1977 Japan ..... 346/141

*Primary Examiner*—John P. McIntosh

*Attorney, Agent, or Firm*—Andrus, Sceales, Starke & Sawall

[57] ABSTRACT

A discharging head assembly for marking apparatus has a chamber for marking fluid with a plurality of fluid dispensing orifices which are closeable and openable by displaceable closure elements connected via flexible pulling means to respective actuators which are spaced from the chamber, and can therefore be relatively bulky, e.g. strong electromagnets.

8 Claims, 3 Drawing Figures

FIG. 1
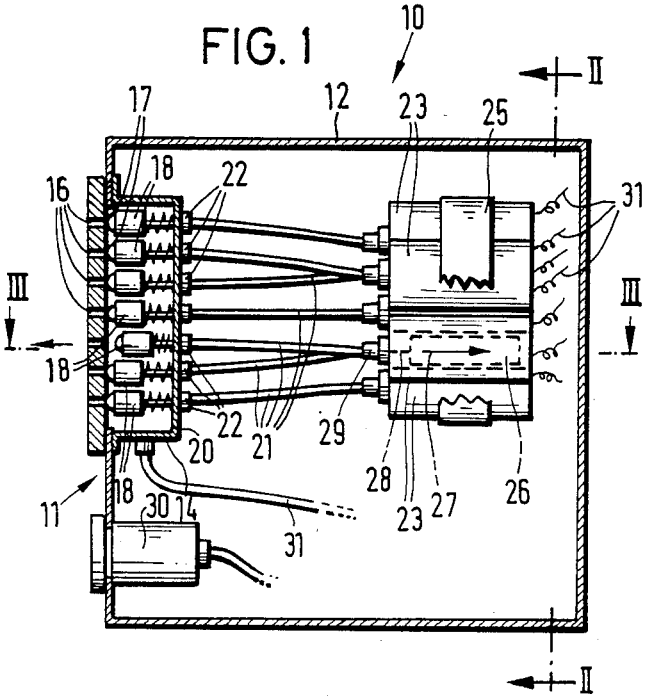
FIG. 2
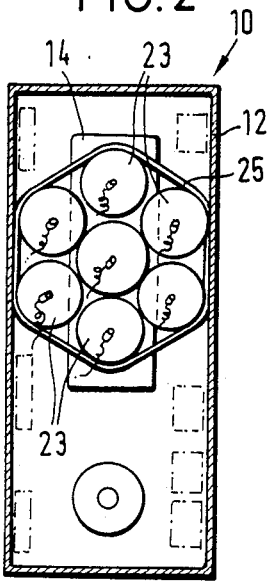
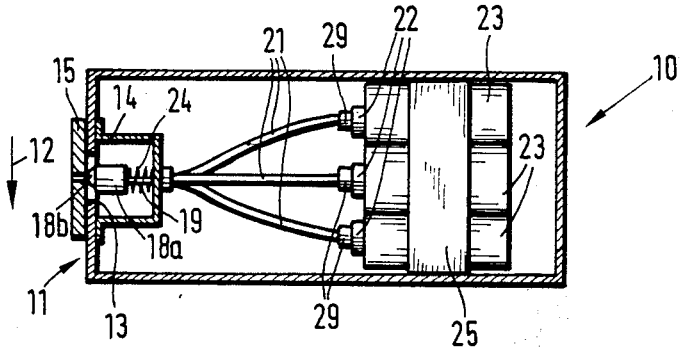
FIG. 3

MARKING JET DISCHARGING HEAD

BACKGROUND OF THE INVENTION

The invention relates to marking jet discharging head, particularly for apparatus for the marking of objects. In another aspect it relates to such marking apparatus.

One type of marking apparatus for applying symbols and inscriptions to packages or other articles uses a discharging head having jet orifices which are arranged in a row and which are briefly actuated in an electronically controlled sequence and discharge dots of marking colour material which together form the desired symbol or inscription on to the package as the latter is being conducted past. The row of jet orifices either are supplied with colour through colour conduits which are opened and closed by electromagnetic valves, or they communicate directly with a colour chamber and their orifice opening facing towards the colour chamber is closed by a closure element which is arranged on the rod of a push element which briefly lifts the closure element away from the orifice opening and presses it back again on to the said opening to squirt a small quantity of colour from the orifice. Since the colour jet orifices have to be arranged in a row near one another if the dots of colour which they discharge are to produce a legible configuration, only very little room is available behind the colour jet orifices for the push elements, so that these can be given only very small dimensions. If electromagnets are used as the push elements, because of the small dimensions which are all that can be allowed the electromagnets are of relatively low power and have a small pushing force, so that they produce a small application pressure on the closure elements. Therefore, faults readily occur in the sequence of operations. The colour jet orifices also have to be at a certain minimum spacing from one another which is determined by the push devices, so that the minimum practicable height of the inscription is limited.

Preferred embodiments of the invention obviate or ameliorate these disadvantages and may provide discharging heads in which orifices can be arranged very near to one another, and reliable opening and closing of each individual jet orifice is guaranteed.

SUMMARY OF THE INVENTION

According to the present invention in one aspect there is provided a marking jet discharging head assembly having a chamber for fluent marking material, means defining a plurality of outlet orifices from said chamber, a plurality of closure elements which are selectively displaceable to open and close respective outlet orifices, resilient means arranged to urge said elements to close the orifices; a plurality of pulling means actuable to effect pulling and associated with respective closure elements and spaced therefrom, and a plurality of elongate pulling elements connecting the closure elements to respective pulling means so that the pulling means are actuable to pull respective elements against the urging of the resilient means to open respective orifices.

In another aspect the invention provides marking apparatus including such a discharging head and means for causing relative displacement of articles to be marked and the head.

In preferred embodiments, relatively large and powerful withdrawal devices can be combined together in a group or cluster which is of substantially larger dimensions than the colour chamber, since the individual withdrawal devices to not have to be arranged coaxially with the orifice openings. Since the jet orifice openings are kept closed by the closure elements which are resiliently urged, no colour can stick to the jet orifice openings which are nearest to the colour chamber and clog the openings or make the edges of the openings sticky. Therefore, the closure elements are always seated in a satisfactory manner on the jet orifice openings which they close. Relatively strong springs can be used for applying pressure on the closure elements, and not only ensure reliable closure but also make the closure element move at a high speed towards the jet orifice opening when they are released by their withdrawal devices. In this way the quantity of colour issuing into the colour jet orifices when the closure elements are opened can be accelerated by the closure elements in the jet orifice and discharged at a high speed from the jet orifice on to the object which is to be marked.

Small pneumatic cylinders can be used as withdrawal devices. But it is particularly advantageous if the withdrawal devices are strong electromagnets, with flexible pulling means secured to the movable parts of these. The flexible pulling means may be flexible wires which extend outside the chamber in pipes or flexible tubes which are connected in pressure-tight and fluid-tight manner at one end to the chamber and at the other end to the withdrawal devices. It is also advantageous for the pulling means to be connected in longitudinally adjustable manner to the withdrawal devices. It is then possible so to adjust the setting of the closure elements that the pulling means lift the closure elements in play-free manner from their seating, so that delays in the working cycle are obviated.

BRIEF DESCRIPTION OF THE DRAWINGS

Further features and advantages of the invention are shown in the following description and the drawings in which a preferred constructional form of the invention is represented in detail by way of example. In these drawings:

FIG. 1 shows a colour jet discharging head embodying the invention in vertical longitudinal section;

FIG. 2 shows the subject of FIG. 1 in a vertical cross-section taken on the line II—II; and FIG. 3 shows the subject of FIG. 1 in a horizontal longitudinal sectional view taken on the line III—III.

DESCRIPTION OF THE PREFERRED EMBODIMENT

In the drawings, 10 designates a colour jet discharging head for marking apparatus, the objects to be marked along taken past the front 11 of said head, with some spacing, in the direction shown by arrow 12, and marked in known manner. The colour jet discharging head 10 has a substantially rectangular housing 12 whose front wall comprises an opening 13 the shape of which is elongated in the vertical sense, and behind which there is provided a substantially rectangular colour chamber 14. In front of the elongated opening 13 there is situated a jet orifice plate 15 with a plurality of colour nozzles or jet orifices 16 which are arranged in a row one above the other and whose rear openings 17 are closed by closure elements 18. Each closure element 18 consists of a small piston **18*a* with a conical head 18*b* which engages partly into the rear opening of the respective associated colour jet orifice 16. Secured to the rear end of the piston is a flexible pulling means 19, in the illustrated constructional example a flexible wire, which is taken out through a bore not shown here in the rear wall 20 of the colour chamber 14 and is accommodated in a flexible tube 21 which leads to one of several withdrawal devices 22**.

Each flexible tube 21 is secured with a pressure-tight and fluid-tight screwed fastening 22 at one end to its withdrawal device and at the other end to the rear wall 20 of the colour chamber.

Each closure element 18 is under the influence of a compression spring 24 which surrounds the flexible pulling means 19, bears against the rear wall 20 of the colour chamber 14, and tends to press the closure element 18 against the jet orifice opening 17 of the jet orifice 16 associated therewith.

In the case of the constructional example illustrated, the withdrawal devices 23 consist of strong electromagnets which are clustered together in the housing 12, some above each other, gripped by an encircling band 25, and secured thus on the side walls of the housing 12. Each electromagnet has an armature 26 which, when current is applied to the coil, is attracted in the direction of the arrow 27, and on one end of which the pulling means 19 of the closure element 18 associated with it is secured. In order to allow each pulling means 19 to be adjustable as to its length, it is connected with the armature 26 of its withdrawal device 23, or a rod 28 secured to such armature, by a screwed fastening 29 which allows axial adjustment of the mutual positions of pulling means 19 and armature 26.

When a photoelectric cell 30 situated in the lower portion of the colour jet discharging head detects the beginning of the object which is to be marked and is being taken past in the direction indicated by the arrow 12, the electronic control apparatus for actuating the withdrawal devices 23 is switched on. As a result, in accordance with a predetermined program, current is supplied to the electromagnets of the withdrawal device 23 through the lines 31, whereby the electromagnets are energised in succession in some cases, simultaneously in others. By means of the pulling means 19 sliding in the flexible tube 21, the armature 26 of each magnet draws the associated closure element 18 rearwards, whereby the respective jet orifice is opened, and the pressurised colour present in the colour chamber 14 can issue from the opened jet orifice 16.

Since each electromagnet is only energised for a very brief period of time and falls off again at once, the associated closure element 18 is only lifted very briefly from the jet orifice opening 17, and then pressed back again at once by the associated spring 24. This return travel is carried out very suddenly, so that the colour present in the jet orifice opening is accelerated and ejected under high pressure from the jet orifice opening, and produces a dot of colour on the object being taken past the opening.

The colour is fed to the colour chamber 14 through a delivery conduit 31 which is connected to the underside of the colour chamber 14.

The invention is not limited to the illustrated constructional example, and instead several modifications and additions are possible without departing from the framework of the invention. For example the withdrawal devices used may be small pneumatic cylinders, the pulling means 19 being secured to the pistons of such cylinders.

While the invention has been illustrated above by reference to the preferred embodiments, it will be understood by those skilled in the art that various changes may be made without departing from the spirit and scope of the invention, and it is intended to cover all such changes and modifications by the appended claims.

I claim:

1. A printing jet discharge head assembly for applying characters to an article, said head assembly comprising:

a chamber for receiving and holding printing liquid under pressure;

a plurality of outlet orifices in said chamber for discharging printing liquid therefrom, said outlet orifices being arranged sufficiently close together to form legible characters from the discharges of said orifices;

a plurality of closure elements within said chamber and operatively associated with respective outlet orifices, said closure elements being selectively displaceable toward and away from said outlet orifices for closing and opening respective orifices;

resilient means to urge said closure elements toward said outlet orifices for closing said orifices;

a plurality of pulling means for selectively moving said closure elements away from said outlet orifices for opening said orifices to discharge printing liquid therefrom to form the characters, said pulling means comprising a plurality of selectively operable actuators located outside said chamber, said actuators being of a size too large to enable direct coupling to said closely spaced closure elements, and a corresponding plurality of flexible pulling elements, each of said flexible pulling elements connecting a respective one of said actuators with a respective one of said closure elements to enable said actuators to selectively withdraw said closure elements from said orifices, the flexible pulling elements obtaining the coupling of the actuators to the closure element while permitting a substantially unrestricted location of said actuators relative to said chamber and closure elements.

2. The printing jet discharging head assembly according to claim 1 wherein said pulling means includes a hollow flexible tube connected to each of said actuators and sealingly connected to said chamber proximate one of said closure elements, and wherein said flexible pulling element comprises a flexible wire passing through each of said flexible tubes to couple each of said actuators to one of said closure elements.

3. The printing jet discharging head assembly according to claim 1 wherein said closure elements are so arranged as to be axially displaceable toward and away from said respective orifices.

4. The printing jet discharging head assembly according to claim 1 further including adjustment means operatively associated with said flexible pulling element and actuator for adjusting their operation to the location of the associated actuator.

5. The printing jet discharging head assembly according to claim 1 wherein said actuator is an electromagnetic linear motor.

6. The printing jet discharging head assembly according to claim 5 wherein said actuator is a solenoid.

7. The printing jet discharging head assembly according to claim 1 wherein said chamber and actuators are mounted in a common housing.

8. The printing jet discharging head assembly according to claim 1 further defined as operatively associated with means for effecting relative movement between an article to be marked and said assembly.

* * * * *